US005531541A

United States Patent [19]

Clover et al.

[11] Patent Number: 5,531,541

[45] Date of Patent: Jul. 2, 1996

[54] MANHOLE COVER LIFTING APPARATUS

[75] Inventors: Daniel S. Clover, Boonton; Mark S. Sisco, Roseland, both of N.J.

[73] Assignee: Fairfield Industries, Fairfield, N.J.

[21] Appl. No.: 408,075

[22] Filed: Mar. 22, 1995

[51] Int. Cl.[6] ..... E02D 29/14

[52] U.S. Cl. ..... 404/25; 220/331

[58] Field of Search ..... 52/20; 404/25, 404/26; 220/210, 211, 331

[56] References Cited

U.S. PATENT DOCUMENTS

| | | | |
|---|---|---|---|
| 1,028,499 | 6/1912 | Schott | 220/331 |
| 1,225,679 | 5/1917 | Ransehousen | 404/25 |
| 1,634,029 | 6/1927 | Korkames | 220/331 |
| 3,513,605 | 5/1970 | Smith | 52/20 |
| 3,930,739 | 1/1976 | Larsson et al. | 404/26 |
| 4,181,290 | 1/1980 | Affolter . | |
| 4,461,597 | 7/1984 | Laurin . | |

FOREIGN PATENT DOCUMENTS 180783 12/1917 Canada .

*Primary Examiner*—David J. Bagnell
*Assistant Examiner*—James A. Lisehora
*Attorney, Agent, or Firm*—William Squire

[57] ABSTRACT

A manhole cover is seated on a flange in a frame from which depends a skirt forming an access opening to a cavity. A cover lifting mechanism external the access opening includes an arm secured to the cover and a tubular cylinder fixed to the skirt, the cylinder including internal aligned journal bushings. A tubular shaft depends from the arm into the journal and axially displaces and rotates about the journal axis. The shaft has an axially extending central bore with a threaded portion. A threaded rod in the central bore rotates about the shaft axis and is captured to a bearing secured to the cylinder lower end. The rod upper end is squared to receive a socket wrench for manually turning the rod with a mechanical advantage which lifts the shaft, the arm and thus the cover out of its seat. Once lifted, the cover is readily rotated away from the access opening by rotating the shaft in the journal while the threads remain engaged.

19 Claims, 5 Drawing Sheets

MANHOLE COVER LIFTING APPARATUS

This invention relates to apparatus for lifting manhole covers.

Manhole covers are steel plates that are placed over access openings to underground cavities. The cavities may be sewer tunnels, storage tanks, equipment tunnels and caverns for power and communication lines and so on. The cavities have an access opening usually circular, but also square or rectangular. Typically the cavities are located under road beds or drive ways over which heavy vehicles such as trucks, cars and the like traverse. The plates are required to bear the loads of the vehicles without damage. Often the plates are in place for long periods of time before removal is required to obtain access to the covered cavity.

Typical steel plates are large, for example 36 or 48 inches in diameter or equivalent areas if square or rectangular. These plates are heavy and may weigh 150–200 pounds each. The plates are required to be flush with the road or drive surface and therefore are seated in a depressed frame seat flush with the ground surface. A skirt usually depends from the frame. The skirt and frame assembly are also usually encased in concrete in the ground to secure the assembly in place.

Most prior art plates need to be lifted manually using crow bars or similar elongated steel rods to dislodge the plates from their seats. These bars are operated manually and while the plates are dislodges they are then manually grasped usually requiring at least two persons to lift the plate from its seat and carry it or displace it out of the way from the access opening. This is relatively hard work because often dirt and grime is forced into the space between the frame and the seat sealing the plate in place. Also the lifting operation is dangerous and tends to cause injury to workers. An accidentally falling plate can seriously hurt a worker.

The prior art in an attempt to deal with this problem has developed spring load mechanisms for tilting the manhole cover plates upward over the access opening. However, such mechanisms are not satisfactory in that they are located in and cover a portion of the access opening and limit the use of the opening in passing equipment into and out of the access opening. For example, the cover may be tilted over the opening not entirely freeing the opening vertically over the opening.

The mechanism being located in the opening is not desirable because often equipment to be installed in the cavity or removed from the cavity is closely dimensioned the same dimensions as the access opening. Any undesired significant blockage of the opening thus precludes use of such mechanisms. Therefore, these mechanisms have not achieved widespread commercial success.

U.S. Pat. No. 4,461,597 shows a cover lifting mechanism using a screw type device and a lever base operated by a screw for lifting valve box covers. This mechanism is relatively complex and does not deal with the problem of how to move the cover out of the way of the opening inlet covered by the cover. The additional mechanism attached to the cover adds further weight to an already heavy cover. Therefore, there is limited access to the opening.

Canadian patent no. 180783 solves the problem of providing access to the opening by providing a lifting mechanism outside the opening, the cover extending over the opening cantilevered from the mechanism. The lifting mechanism employs opposing cams and proposes to lift the cover in an approximately 90° turn of the mechanism. A shank and bit tool are used to rotate the cam mechanism. The tool is locked to the mechanism once the cover is removed so that the cover has to be replaced before the tool can be removed.

The present inventors believe that the use of cams is not practical for very heavy covers as the entire weight needs to be lifted in a quarter turn which has a minimum mechanical advantage.

A manhole cover lifting apparatus according to the present invention for lifting the cover off a seat in a cover support structure, the cover support structure defining an access opening to a cavity covered by the cover, comprises cover support means for attachment to the cover and lifting means secured to the cover support means and including means arranged to be secured to the support structure for vertically lifting the cover support means relative to the support structure in an axial direction parallel to the force of gravity free of the cover seat and including means for permitting the lifted cover to rotate laterally transverse the axial direction away from the opening to provide access to the opening.

The lifting means comprises a bushing member having a cylindrical opening defining an axis extending in the axial direction; means for securing the bushing member to the support structure in fixed position; a shaft axially and rotationally displacably secured to the bushing member in the cylindrical opening for selective displacement in the axial direction and for rotating about the axis relative to the bushing member; means for securing the shaft to the cover support means; bearing means secured to the bushing member in fixed axial position and shaft drive means supported by the bearing means coupled to the shaft for supporting and displacing the shaft relative to the bushing member along the axis to lift the cover support means and cover secured thereto.

In one embodiment the bearing means include a bearing for providing rotational and axial thrust support for a drive rod during at least one complete rotation of the drive rod.

In a further embodiment, the apparatus includes securing means for securing the lifting means to the support structure external the access opening to free the opening for substantially full access to the opening.

In a further embodiment, the drive means includes screw means supported on the bearing for lifting the shaft and cover.

Figure 1:
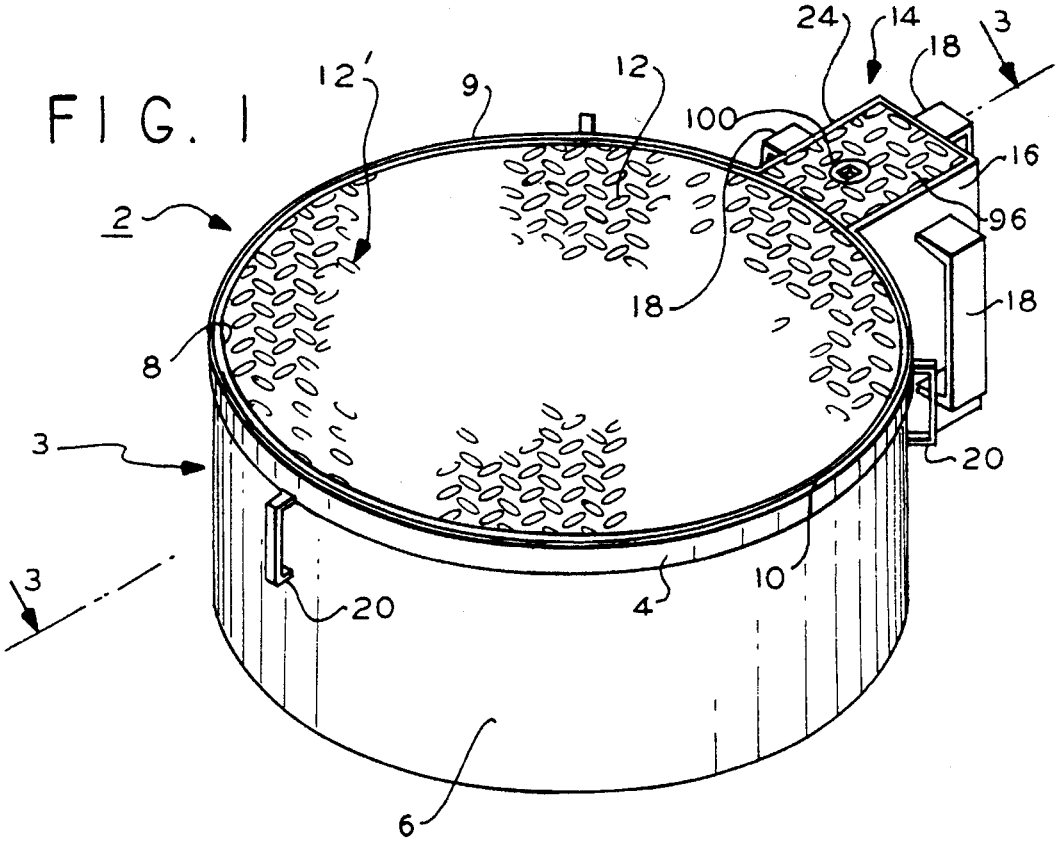
FIG. 1 is an isometric view of an assembled closed apparatus according to one embodiment of the present invention.
Figure 2:
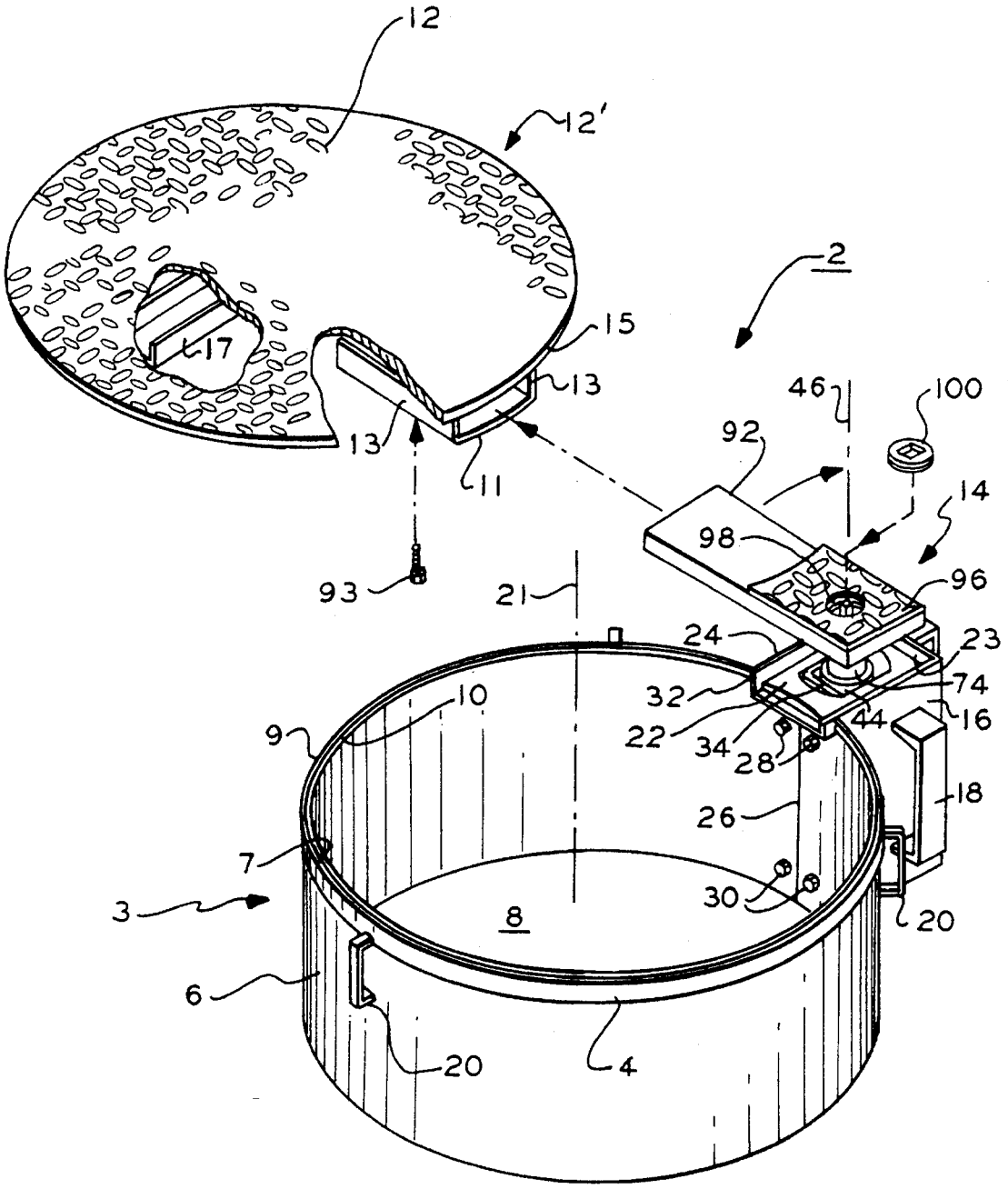
FIG. 2 is a partially exploded view of the apparatus of FIG. 1 in the cover open state.

In FIGS. 1 and 2, manhole cover apparatus 2 includes a support structure 3 comprising a manhole cover frame 4 with a depending skirt 6 both defining a circular cylindrical access opening 8. The frame 4 has at its upper edge 9 a circular recessed cover seat 7 formed by a radially inwardly extending annular flange 10. A housing 16 is secured to the external peripheral surface of skirt 6 and frame 4, for example, by welding. The skirt 6, FIG. 2, has a welded seam 26 parallel to skirt and frame central axis 21 straddled by two parallel pairs of through bolt holes through which bolts 28 and 30 pass. Various U-shaped members 18 and 20 are secured external the respective housing 16 and frame 4-skirt 6 assembly to secure the apparatus in concrete for installation in a known manner.

Cover assembly 12' includes a circular steel disk cover 12 seated on the flange 10 in the recess within the frame 4. The seated cover 12 which may be 48 inches, or larger or smaller or rectangular according to a given implementation, is generally flush with upper edge 9 of the frame 4 and upper edge 24 of the housing 16. The cover 12 includes a rectangular in section steel channel 11 forming a sleeve. The channel legs 13 are welded at their edges to the underside of the cover 12 with the channel 11 extending radially relative to axis 21. An end edge of the channel 11 is flush with edge 15 of the cover. A second U-shaped reinforcing load bearing steel channel 17 is welded diametrically across the under side of the cover 12.

Figure 3:
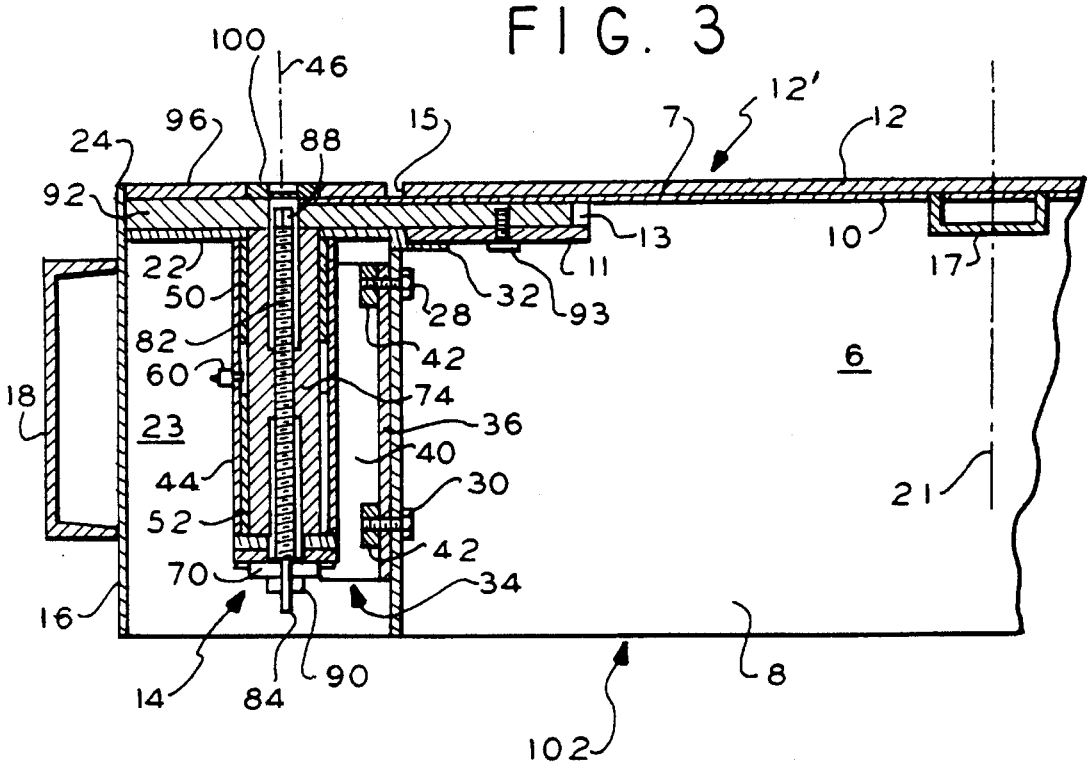
FIG. 3 is a sectional fragmented elevation view of the apparatus of FIG. 1 taken in the plane of lines 3—3.

In FIGS. 1, 2 and 3, a cover lifting mechanism 14 is mounted in the cavity 23 of preferably steel channel U-shaped housing 16 which is welded at the housing channel longitudinal edges to the external peripheral surface of the frame 4 and skirt 6 with the channel parallel to axis 21. The housing 16 has an upper plate 22 recessed in the housing cavity 23 adjacent to the housing upper edge 24. A U-shaped channel member 32 is welded to the frame 4 and extends radially inwardly into opening 8 below plate 22 for receiving the edge end of channel 11 of the cover 12.

Figure 4:
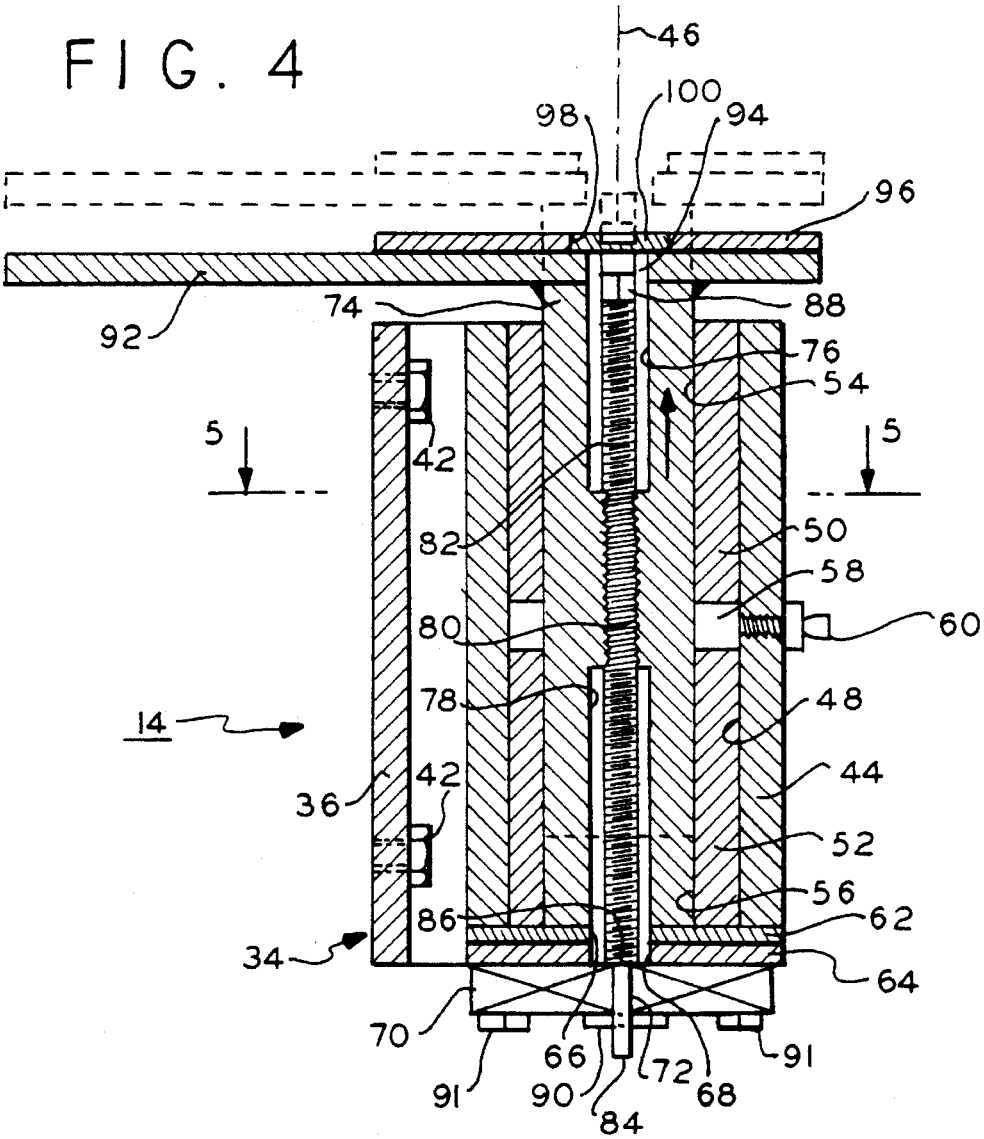
FIG. 4 is a more detailed elevation sectional view of the lifting mechanism portion within the lifting mechanism housing similar to the sectional view of FIG. 3 but taken in the opposite direction from the view of FIG. 3.
Figure 5:
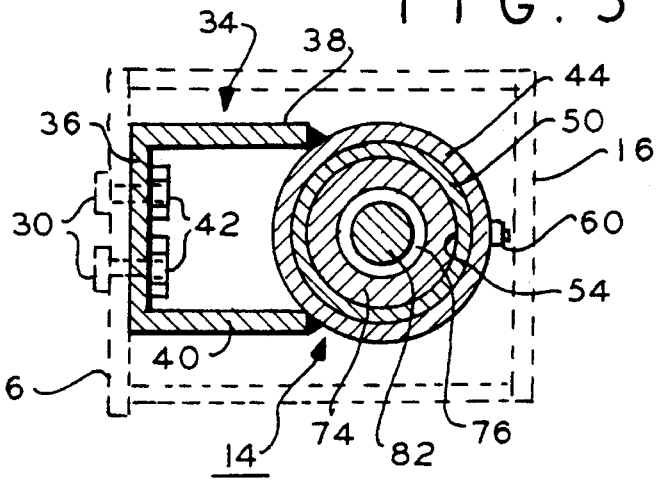
FIG. 5 is a plan sectional view of the mechanism of FIG. 4 taken in the plane of lines 5—5.

In FIGS. 4 and 5, the lifting mechanism 14 comprises a U-shaped channel support 34, preferably steel, having a base wall 36 and a pair of spaced upstanding legs 38 and 40. Four threaded bosses 42 are welded to base wall 36 for receiving bolts 28 and 30 to secure the support 34 in cavity 23 and to the external peripheral surface of skirt 6 shown in phantom in FIG. 5. The legs 38 and 48 extend parallel to the opening 8 axis 21. A circular cylindrical tubular steel cylinder 44 is welded to the extended edges of the legs 38 with the longitudinal axis 46 of the cylinder 44 parallel to axis 21. The cylinder 44 has a circular cylindrical bore 48 concentric with axis 46.

A pair of circular cylindrical axially aligned bushings 50 and 52, preferably brass, has axially aligned respective bores 54 and 56 of the same diameter concentric about axis 46. The bushings 50 and 52 are press fit into the bore 48 of the cylinder 44 in axial spaced relation forming an annular space 58 therebetween. A grease fitting 60 is threaded to cylinder 44 in communication with the space 58 to provide grease to the internal bore 54 and 56 surfaces of the bushings 50 and 52. A pair of steel circular disks 62 and 64 with central respective bores 66 and 68 concentric with axis 46 are welded to the lower end of cylinder 44. A bearing 70 is bolted beneath and to disks 62 and 64 by bolts 91, the bearing 70 having a central axially extending bore 72 concentric with axis 46. This bearing is sometimes referred to as a flange unit.

In the alternative, the bearing such as bearing 70, may be bolted to support 34. In this case, the support 34 is provided with an additional steel wall (not shown) parallel to wall 36 and welded to legs 38 and 48. The bearing is then bolted to this additional steel wall with the bolts oriented normal to the orientation of bolts 91 in the same orientation as bolts 42, FIG. 4. However, the bearing so bolted has its bore 72 oriented as shown for bearing 70. This latter bearing is sometimes referred to as a pillow block. Both bearings are commercially available.

Figure 8:
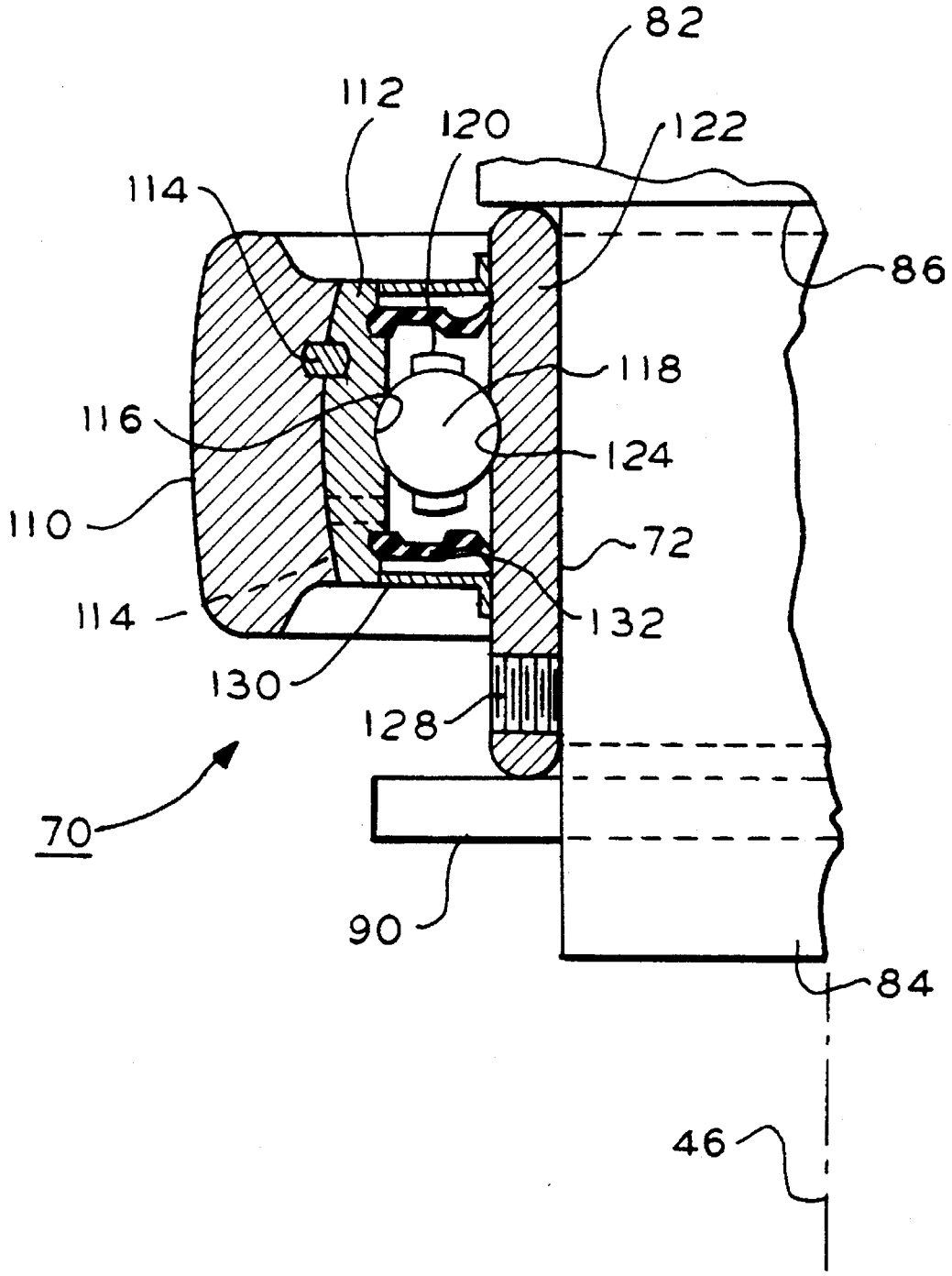
FIG. 8 is a fragmented sectional elevation view of a bearing used in the embodiment of the present invention to provide axial thrust support for the weight of the cover.

Bearing 70 is shown in more detail in FIG. 8. Bearing 70 includes a housing 110, preferably cast iron, which extends around the entire periphery of the bearing. The housing includes apertures, not shown, for bolting the bearing to a support. The apertures may extend from the top of the drawing to the bottom as illustrated in FIG. 4 or from left to right in FIG. 8. In the latter case, the pillow block type, the housing 110 is generally circular cylindrical and includes oppositely extending coplanar flanges whose plane is parallel to the sides of the figure.

Bearing 70 includes an outer circular cylindrical metal race 112 pinned to housing 110 by pins 114. The race 112 has an annular inner bearing groove 116 in which ball bearings 118 (only one being shown) are seated. The bearings 118 are retained in an annular metal retainer 120. A circular tubular metal inner race 122 extends beyond the housing and is referred as an inner ring. Race 122 has an annular groove 124 in which bearings 118 are seated. Race 122 has an inner circular cylindrical bore forming bore 72. A set screw 128 is in communication with the bore 126. The bearing also includes a seal on opposite sides of the bearing for sealing the region between the inner and outer races. The seal comprises an L-shaped metal outer seal 130 referred to as a slinger and a synthetic inner rubber seal 132 both connected between the races.

A circular cylindrical tubular steel shaft 74, FIGS. 3–5, is rotationally and axially slidably secured within the bores 54 and 56 of the respective bushings 50 and 52. The shaft 74 can axially displace along axis 46 and rotate about the axis 46. The shaft 74 acts as a bearing and the bushing bores 54 and 56 serve as journals for the shaft 74. Grease filled in the space 58 can enter the interface between the shaft 74 and bushings 50 and 52 to facilitate the axial displacement and rotation of the shaft 74.

The shaft 74 has a pair of axially spaced bores 76 and 78 of the same diameter axially extending along axis 46 and concentric therewith. An axially extending threaded bore 80 is approximately centrally the length of the shaft 74, is between bores 76 and 78 and of slightly smaller diameter than the bores 76 and 78 and also concentric with axis 46. The bore 80 threads may be, for example, ¾–6 acme threads and extend axially for about 3 inches in this example, the shaft 74 axial length being about 10 inches. The shaft 74 may have a outer diameter of about 2 inches with the bores 76 and 78 being about ¼ inches in diameter in this example. The cylinder 44 may be about 3 inches in outer diameter with a 2½ inch bore 48 diameter and an axial length of about 8.5 inches. The bushings 50 and 52 may have an axial length of about 3 inches each in this embodiment and a ¼ inch thickness.

A threaded cylindrical elongated drive rod 82 has external threads which mate with and engage the threads of bore 80. The rod 82 is located within and passes through bore 78. The rod 82 has a lower portion which terminates in a circular cylinder 84 of smaller diameter than the rod threaded portion. Cylinder 84 forms a shoulder 86 which sits on the bearing 70 inner race 122 (FIG. 8) and can not pass through the bearing 70 bore 72. A shear pin 90 passes through the cylinder 84 beneath bearing 70 capturing the rod 82 to the bearing race 122 between the shoulder 86 and pin 90. The rod 82 has an upper portion which is located within shaft 74 bore 76 and terminates at squared end 88 at the upper end of the rod and bore 76. The rod 82 cylinder 84 axial thrust loads are thus supported in the direction of the force of gravity parallel to axis 46 by the bearing 70 via race 122, bearings 118, race 112 and housing 110 (FIG. 8). The rod 82 may be secured to the race 122, FIG. 8, by screw 128. Rod 82 thus is rotationally supported for rotation about axis 46 by bearing 70 while axially fixed in place.

The upper end of the shaft 74 is welded to a preferably steel elongated rectangular plate 92. Plate 92 has a width and thickness so as to be closely releasably received in the rectangular sleeve formed by channel 11 and cover 12. A screw 93 secures the plate 92 to the channel 11, FIG. 3. Plate 92 has a circular opening 94 of about the same diameter as bore 76 and axially aligned therewith on axis 46. A finishing plate 96 is welded over plate 92 and of the same area and transverse shape as housing 16 cavity 23 to closely fit within the cavity 23 as best seen in FIG. 1. Plate 96 is of the same material as cover 12 and sits flush with the housing 16 edge 24 within the housing 16 in a manner similar to the flush upper surface of cover 12 relative to the frame 4. As seen in FIG. 3, the plate 92 sits on plate 22 in the cover closed position (FIG. 1).

In FIG. 4, plate 96 has a threaded bore 98 aligned with bore 94 of plate 92. A plug 100 is threaded to bore 98 to enclose the bore 98 and the lifting mechanism aligned with and internal the bore 98.

As seen in FIG. 4, the lifting assembly 14 is fabricated as a separate subassembly. The support structure 3 comprising frame 4, FIG. 2, skirt 6, housing 16 including plate 22 and channel 32 are formed as a separate subassembly. The cover assembly 12', FIG. 2, is formed as a still further subassembly. In FIGS. 2 and 3, the bolts 28 and 30 are used to attach the lifting assembly 14 in the cavity 23 of the housing 16. In FIG. 2, with the assembly 14 attached to the support structure 3 in housing 16, the plate 92 forms a cantilevered arm extending from shaft 74.

Figure 6:
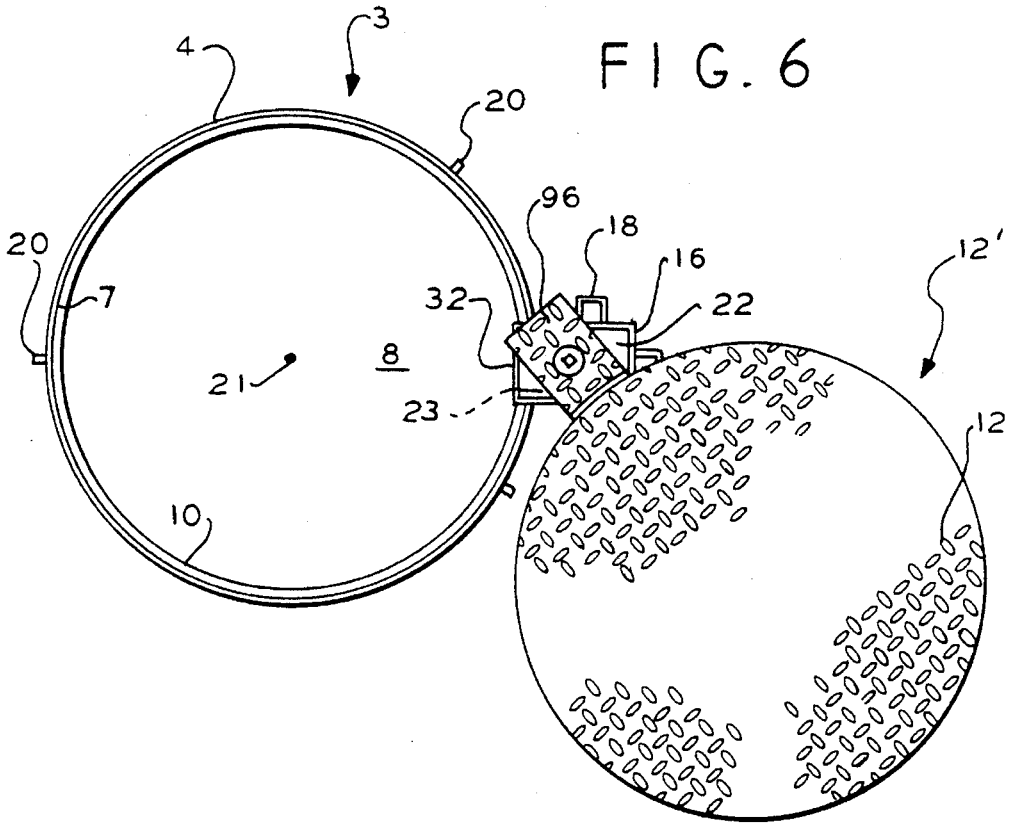
FIG. 6 is a plan view of the apparatus of FIG. 1 showing the cover in an open state different than that of FIG. 2.

Plate 92 is then attached to the cover assembly 12' by sliding the plate 92 portion extending from plate 96 into the sleeve formed by channel 11 and cover 12. When fully inserted, the plate 96 is closely spaced from the cover 12 as seen in FIGS. 1 and 6. When fully inserted screw 93 is threaded to channel 11 and locks the plate 92 arm portion to the cover 12. In this position the cover 12 is cantilevered from the lifting mechanism 14 as seen in FIG. 7.

In operation, assuming the cover 12 is closed as shown in FIG. 3, the plug 100 is removed from the lifting mechanism 14 to expose the squared end 88 of rod 82. In FIG. 7, a socket wrench 104 is attached to end 88 of rod 82. The wrench is then manually rotated to lift the cover assembly 12' vertically out of the seat 7 of the support structure 3 parallel to axes 21 and 46. This is a matter of one inch or less of vertical lifting. This lifting is relatively easy due to the leverage of the threads on the rod 82 and shaft 74. For example, one or more full rotations of the rod 82 will lift the cover the desired distance, the greater the number of rotations the greater the mechanical advantage.

Figure 7:
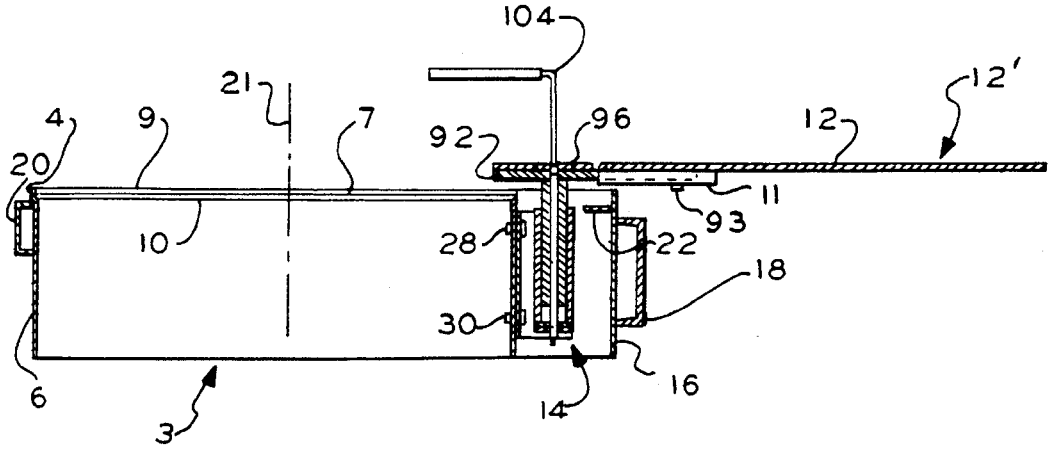
FIG. 7 is a sectional elevation view of the apparatus of FIG. 1 in an open state similar to that shown in FIG. 6, but with the cover opened 180° from the cover closed state of FIG. 1.

Once the cover 12 is lifted above the upper edge 9 of the frame 4, it is then manually rotated in any direction about axis 21 to a desired position such as shown in FIGS. 2, 6 or 7. This rotation is permitted by the threaded engagement of the rod 82 with the shaft 74 which results in some lifting of the cover. In the alternative, because the rod 82 is rotatably mounted via bearing 70, the rod 82 and shaft 74 are easily rotated in unison as the cover is rotated about axis 46 without lifting the cover during the rotation.

In FIG. 7, for example, access to the entire opening 8 is possible notwithstanding the relatively unobtrusive portion of channel 32 (FIG. 6). This small portion of channel 32 permits access to substantially all of opening 8 for passing equipment generally of about the same dimensions as opening 8. Such equipment generally is not exactly the same diameter or size as opening 8 and readily is passed thereinto or therefrom. The entire opening 8 is for practical purposes accessible for both people and equipment.

The important aspect is that no heavy manual lifting is required and the cover assembly 12' is easily lifted with a relatively high mechanical advantage and rotated whether for opening or closing the opening 8. The cover assembly 12' once seated flush on the structure 3 as in FIG. 1 readily permits heavy vehicles to pass thereon. Regardless the time in use, merely removing the plug 100 permits ready access to the lifting assembly which is substantially sealed within the housing 16 relative to the ambient atmosphere.

It will be appreciated that a vertical lifting mechanism as shown and described herein may be installed within the opening 8 interior the skirt 6 if the size of the opening is not critical for its intended use. It will occur to one of ordinary skill that various modifications may be made to the disclosed apparatus which is given by way of illustration and not limitation.

For example, while a threaded arrangement is disclosed for lifting the shaft relative to the bearing 70, other arrangements may be provided such as hydraulic or pneumatic lifting devices. Such devices would be secured to the bearing 70 inner race and coupled to a shaft such as shaft 74. The hydraulic or pneumatic arrangements may then be coupled to external power sources or jack handle for selective axial shaft displacement. The bearing such as bearing 70 would support the entire axial thrust load of the shaft and hydraulic or pneumatic arrangements while permitting them to rotate with the cover after lifting. The scope of the invention is as defined in the appended claims.

What is claimed is:

1. Manhole cover lifting apparatus for lifting the cover off a seat in a cover support structure, the cover support structure defining an access opening to a cavity covered by the cover, said apparatus comprising:

cover support means for attachment to the cover; and lifting means secured to the cover support means and including means arranged to be secured to the support structure for lifting the cover support means relative to the support structure in an axial direction parallel to the force of gravity free of the cover seat and including means for permitting the lifted cover to rotate laterally transverse to said axial direction away from said opening to provide access to said opening, the lifting means comprising:

a bushing member having a cylindrical opening defining an axis extending in the axial direction;

means for securing the bushing member to the support structure in fixed position;

a shaft axially and rotationally displacably secured to the bushing member in the cylindrical opening for selective displacement in the axial direction and for rotating about the axis relative to the bushing member;

means for securing the shaft to the cover support means;

bearing means coupled to the means for securing in axial fixed position relative to the bushing member; and shaft drive means axially and rotationally supported by the bearing means for supporting and displacing the shaft relative to the bushing member along the axis to lift the cover support means and cover secured thereto wherein the bearing means provides rotational and axial thrust support for the drive means.

2. The apparatus of claim 1 wherein the drive means includes a drive rod secured to the bearing means in fixed axial position along the axis and including means coupled to the shaft for lifting the shaft in at least one complete rotation of the drive rod.

3. The apparatus of claim 1 wherein:

the bushing means comprises an outer cylinder having an axially extending bore forming said opening;

the shaft comprises a tubular cylinder rotatably and axially displacably secured within the bore of the outer cylinder along the axis, the shaft having an internal threaded bore;

the bearing means comprises a bearing having outer race means secured in fixed axial position relative to the outer cylinder and aligned with the bore on said axis, the bearing including inner race means rotatably coupled to the outer race means in axial fixed position for providing said axial thrust and rotational support about the axis; and the drive means comprises a drive rod axially fixed in place and secured to the bearing inner race means for rotation about the axis, the rod including threads engaged with the threaded bore of the shaft for lifting the shaft in response to rotation of the rod.

4. The apparatus of claim 3 wherein the rod includes means for receiving a tool for rotating the rod relative to the shaft.

5. The apparatus of claim 1 including securing means for securing the lifting means to the support structure external the access opening to free the opening for substantially full access to the opening.

6. The apparatus of claim 5 wherein the shaft has an axially extending bore passing through the shaft, said shaft bore having at least a threaded portion, said drive means including a threaded rod engaged with the threads of said threaded portion, said rod passing through said bore, said bearing means for rotationally securing the rod to said bushing member and for axially capturing the rod to preclude axial displacement of the rod relative to the bushing member whereby the threaded engagement of the rod to the shaft in response to rotation of the rod vertically displaces the shaft while permitting the shaft to rotate relative to the bushing member.

7. The apparatus of claim 6 wherein the bearing means comprises a bearing secured to the bushing member.

8. The apparatus of claim 1 wherein the cover includes a sleeve having a hollow core, said cover support means comprising an arm member attached to the sleeve in said core.

9. The apparatus of claim 1 wherein the means for securing the bushing member to the support structure includes a channel member having a base wall and a pair of spaced legs, said legs being secured to the bushing member and said base wall including means for securing the channel member to said cover support structure.

10. The apparatus of claim 1 wherein the bushing member has a cylindrical bore forming a journal and the shaft has a cylindrical outer surface forming a bearing mating with the journal for axially and rotationally sliding in the journal, screw means axially and rotationally supported by the bearing means, the screw means being coupled to the shaft for axially displacing the shaft relative to the bushing member in response to rotation of the screw means employing the bearing means for axial thrust load induced by the displaced shaft.

11. The apparatus of claim 10 wherein the screw means comprises a threaded rod and the shaft has a threaded bore engaged with the threaded rod, and means coupled to the rod for rotating the rod relative to the shaft.

12. The apparatus of claim 1 further including said cover support structure.

13. The apparatus of claim 12 wherein the drive means and shaft include mating screw means, and the bearing means including a bearing secured to the bushing member for axially and rotationally supporting the drive means, the drive means axially supporting the shaft.

14. A manhole cover lifting apparatus comprising:

an annular cover support structure defining an access opening to a cavity covered by the cover, said structure having an annular wall including an annular cover receiving seat;

a cover with an annular periphery resting in said seat;

a cover lifting arm releasably secured to the cover; and a lifting mechanism secured to the arm and to the support structure for displacing the cover out of the seat in an axial direction parallel to the force of gravity and for permitting the cover and arm to rotate in a direction to uncover said access opening, the lifting mechanism including a bearing secured to the support structure in fixed axial position for rotatably and axially supporting the lifted cover, a cover support member secured to the arm and screw means rotationally secured to the bearing in axial fixed position and coupled to the cover support member and including means responsive to the rotation of the screw means for axially lifting the cover support member.

15. The apparatus of claim 14 including means for securing the mechanism external said wall and cavity.

16. The apparatus of claim 14 wherein the screw means includes an outer journal secured to the support structure, an inner threaded shaft rotationally and axially displaceable in the journal and a threaded rod rotationally secured to and axially fixed in place to the bearing and engaged with the threads of the inner shaft.

17. Manhole cover lifting apparatus for lifting the cover off a seat in a cover support structure, the cover support structure defining an access opening to a cavity covered by the cover, said apparatus comprising:

a cover support structure having a cover seat for receiving said cover;

a cover for seating in the support structure seat and for selectively covering and uncovering said opening; and means secured to the cover and externally to the support structure for lifting the cover in translation parallel to the direction of the force of gravity free of the cover seat and for then permitting the freed lifted cover to rotate laterally transverse said direction away from vertical alignment with said opening to provide access to said opening, the means for lifting including rotatable drive means secured between and to the support structure and the cover for lifting the cover in response to rotation of the drive means;

said drive means including a bearing secured to said support structure in fixed axial position and a drive assembly means including screw means secured to the bearing and to the cover wherein the bearing vertically supports the drive assembly means and lifted cover while providing rotational support to the cover and means for lifting.

18. Manhole cover lifting apparatus for lifting the cover off a seat in a cover support structure, the cover support structure defining an access opening to a cavity covered by the cover, said apparatus comprising:

cover support means for attachment to the cover;

a support member including means for securing the support member to the support structure;

a bushing member secured to the support member and including a cylindrical journal defining an axis extending in an axial direction;

a shaft having a threaded bore, the shaft having a bearing surface axially and rotationally displacably secured to the bushing member journal in the cylindrical opening for selective displacement in the axial direction and for rotating about the axis;

means for securing the shaft to the cover support means;

a bearing secured to one of the support member and bushing member; and a threaded drive rod coupled to the bearing in axial fixed position and rotatable relative to the shaft bore such that the bearing supports axial loads on the rod, the drive rod threads being engaged with the shaft threads such that rotation of the rod axial displaces the shaft to lift the cover and the bearing supports the axially induced weight of the cover.

19. Manhole cover lifting apparatus for lifting the cover off a seat in a cover support structure, the cover support structure defining an access opening to a cavity covered by the cover, said apparatus comprising:

cover support means for attachment to the cover; and lifting means secured to the cover support means and including means arranged to be secured to the support structure for lifting the cover support means relative to the support structure in an axial direction parallel to the force of gravity free of the cover seat and including means for permitting the lifted cover to rotate laterally transverse said axial direction away from said opening to provide access to said opening, the lifting means comprising:

a bushing member having a cylindrical opening defining an axis extending in the axial direction;

means for securing the bushing member to the support structure in fixed position;

a shaft axially and rotationally displacably secured to the bushing member in the cylindrical opening for selective displacement in the axial direction and for rotating about the axis relative to the bushing member;

means for securing the shaft to the cover support means;

bearing means secured to the bushing member in axial fixed position; and means supported on the bearing means and coupled to the shaft for rotationally supporting and for linearly displacing the shaft relative to the bushing member along the axis to lift the cover support means and cover secured thereto.

* * * * *